United States Patent [19]

Levy

[11] 4,009,041

[45] Feb. 22, 1977

[54] FOGGED, DIRECT-POSITIVE SILVER HALIDE EMULSION CONTAINING A GALLIUM SULFIDE SEMICONDUCTOR

[75] Inventor: Boris Levy, Wayland, Mass.

[73] Assignee: Polaroid Corporation, Cambridge, Mass.

[22] Filed: Oct. 3, 1974

[21] Appl. No.: 511,462

[52] U.S. Cl. ..... 96/120; 96/108; 96/101

[51] Int. Cl.[2] ..... G03C 1/28; G03C 1/02

[58] Field of Search ..... 96/1.5, 95, 107, 108, 96/101, 120

[56] References Cited

UNITED STATES PATENTS

| | | | |
|---|---|---|---|
| 2,399,083 | 4/1946 | Waller et al. | 96/108 |
| 3,109,737 | 11/1963 | Scott | 96/108 |
| 3,121,006 | 2/1964 | Middleton et al. | 96/1.5 |
| 3,367,778 | 2/1968 | Berriman | 96/107 |
| 3,501,310 | 3/1970 | Illingsworth et al. | 96/101 |
| 3,615,519 | 10/1971 | Milton | 96/64 |
| 3,620,750 | 11/1971 | Riester | 96/108 |
| 3,656,962 | 4/1972 | Levy | 96/120 |

FOREIGN PATENTS OR APPLICATIONS

| | | | |
|---|---|---|---|
| 723,019 | 2/1955 | United Kingdom | 96/108 |

*Primary Examiner*—Won H. Louie, Jr.
*Attorney, Agent, or Firm*—Philip G. Kiely

[57] ABSTRACT

The present invention relates to photography and, more particularly, to a novel radiation recording photographic element which comprises a direct positive photosensitive element which includes, in combination, a particulate dispersion of fogged silver halide crystals, adapted to discharge the fogged silver halide upon exposure to electromagnetic radiation actinic thereto, having associated therewith in electron accepting relationship a semiconductor adapted to accept electrons from said silver halide crystals as a function of the exposure of the crystals to incident electromagnetic radiation actinic thereto.

6 Claims, 2 Drawing Figures

FOGGED, DIRECT-POSITIVE SILVER HALIDE EMULSION CONTAINING A GALLIUM SULFIDE SEMICONDUCTOR

BACKGROUND OF THE INVENTION

1. Field of the Invention

The present invention is directed to providing new and improved direct positive radiation recording photosensitive photographic elements.

2. Description of the Prior Art

As is known in the prior art, photographic silver halide elements may be constituted which are adapted to provide, upon photoexposure and processing, direct positive image formation, that is, image formation in terms of the unexposed areas of the element as a function of the point-to-point degree of the elements' exposure to incident electromagnetic radiation actinic to the silver halide crystals constituting such elements. Specifically, the constitution of direct positive silver halide elements adapted to provide the requisite reversal image formation, as a function of photoexposure and chemical processing, is disclosed in substantial detail in a plurality of United States and foreign patents including among others U.S. Pat. Nos. 2,592,250; 3,206,313; 3,317,322; 3,364,026; 3,367,778; 3,501,305; 3,501,306; 3,501,307; 3,501,309; 3,501,310; 3,501,311; 3,501,312; 3,505,070; 3,537,858; and the like.

In general, the aforementioned direct positive silver halide elements comprise a particulate dispersion of substantially uniformly fogged silver halide crystals or grains which in particularly preferred situations may comprise uniformly fogged silver halide grains comprising a central core of silver halide containing centers which promote deposition of photolytic silver and an outer shell covering the core comprising fogged silver halide that is adapted to be rapidly reduced to silver absent photoexposure; the latter structures being described in further detail in U.S. patents such as aforementioned U.S. Pat. Nos. 3,206,313; 3,317,322; 3,367,778; 3,537,858; and the like.

SUMMARY OF THE INVENTION

The present invention is directed to a new and improved radiation recording photographic element which comprises a direct positive photosensitive element which includes, in combination, a particulate dispersion of fogged silver halide photosensitive crystals and, specifically, silver halide crystals adapted to discharge their latent fog image upon exposure to electromagnetic radiation actinic thereto, and adapted to be reduced to silver upon contact with a silver halide reducing agent, having associated therewith in electron accepting relationship a semiconductor adapted to accept electrons from the silver halide crystals as a function of the exposure of the crystals to the incident actinic radiation to spectrally sensitize the crystals to incident actinic radiation.

DETAILED DESCRIPTION OF THE INVENTION

Figure 1:
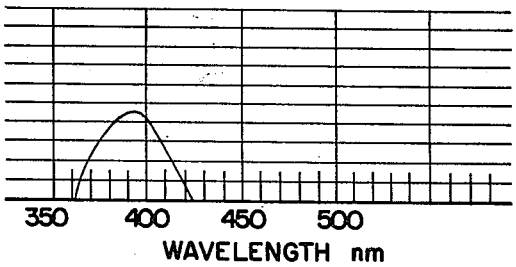
FIG. 1 is a graphical representation of the action spectra, as determined on a wedge spectrograph, of a direct positive photosensitive silver chloride emulsion.

Commensurate with the present invention, enhancement of the photographic action of a direct positive photoresponsive silver halide material may be achieved by electron transfer from said photoresponsive material to an associated electron sink which comprises an inorganic semiconductor adapted to receive electron flow in response to incident electromagnetic radiation.

In general, the absorption of photon excitation derived activating energy, e.g., a photon, by a photoresponsive silver halide crystalline material retaining prefogged silver results in the imagewise discharge of the prefogged silver.

Silver halide, which itself is a semiconductor can be uniformly fogged by overall exposure or by chemical agents known to the art.

The thus-formed uniformly fogged silver halide accordingly is adapted to be developed, or reduced, by conventional direct positive procedures known to the art to provide a visible species by contact with reagents which will react differentially between exposed and unexposed pre-fogged photoresponsive material.

Excitation of the fogged photoresponsive silver halide materials, however, by incident electromagnetic radiation possessing frequencies to which the crystals are responsive in net effect acts to discharge the fog $[(Ag^0)_n \rightarrow nAg^+]$, thus treating the capacity of discharged silver halide to be itself converted to a visible photographic signal.

A variety of photoresponsive silver halides are suitable for use in the present invention such as, for example, silver chloride, silver bromide, and mixed halides such as silver iodobromide and silver iodochlorobromide and the like.

The term "photoresponsive" as employed throughout the present specification is thus intended to refer to a material adapted to receive activating energy of selected wavelengths incident thereon which, as a result of the incident radiation, is adapted to undergo modification to provide a photographic signal, either not obtainable in exposed material or not obtainable at an effective differential rate.

The semiconductor to be employed is adapted to accept electrons directly or indirectly from the silver halide component of the system in response to activating energy impinging on said system. Thus, assuming photons are absorbed directly by the silver halide, the free electrons generated by reason of the incident photon energy, are transferred to the semiconductor electron sink as a function of the photosensitive elements' photoexposure, thus discharging fog carried by photoexposed silver halide. Assuming photons are absorbed directly by the semiconductor, positive holes are generated in the semiconductor by reason of the incident photon energy, discharging fog carried by the prefogged silver halide in contact with the semiconductor. Fog discharge by removing electrons from the photoresponsive component and/or injection of positive holes into the photoresponsive component thus promotes direct positive image formation as a function of the impingement of radiation on fogged silver halide.

Specifically with reference to the electron transfer mechanism, sensitization of the photographic process is understood to occur by the removal of electrons from the prefogged silver halide crystals by the semiconductor material as a result of incident actinic radiation. Positive holes are formed which can react with prefogged silver from the silver halide grains making it unavailable for surface development.

Silver halide dispersions employed for the fabrication of preferred photographic film units comprising sensitized photoresponsive silver halide crystals, as specifically detailed immediately above, may be prepared by reacting a water-soluble silver salt, such as silver nitrate, with at least one water soluble halide, such as ammonium, potassium or sodium chloride, in an aqueous solution of a peptizing agent such as a colloidal gelatin solution by methods known to the art and detailed in the above-indicated U.S. Patents.

The direct positive emulsions employed in the present invention may be fogged by chemical or physical methods known to the art, for example, as described by Antoine Hautet and Henri Saubenier in Science et Industries Photographiques, Vol. XXVIII, January 1957, pages 57–65; U.S. Pat. Nos. 3,062,651; 2,487,850; 2,519,698; 2,521,925; 2,521,926; 2,399,083; and 2,642,361.

The semiconductor may be provided to the formulation by suspension in particulate form in a liquid medium in which it is insoluble and which is nondeleterious to photographic emulsions, such as water, methanol or other lower molecular weight alcohol, or a mixture of water and alcohol; the suspension so formed is then added to and mixed throughout the above-described formulation. Preferably, an inorganic semiconductor is employed.

Alternatively, the silver halide may be formed in the presence of the semiconductor in such a way that a core-shell configuration is obtained, with either material, i.e., the silver halide crystal or a GaS particle, comprising either the core or the shell.

With respect to semiconductor/silver halide ratio, silver halides have been effectively sensitized according to the present inventive concept, by utilizing a molar ratio of one silver halide:one semiconductor, although higher or lower ratios may be suitable, depending upon emulsion and sensitization characteristics desired and relative silver halide/semiconductor contact area.

The particle size of the semiconductor particles has been found not to be critical, except that is will be obvious to those familiar with semiconductor theory that the particle size and configuration must be such as to provide for adequate interfacial contact between the silver halide crystals, sensitizing dye and semiconductor particles. In practice, sonified suspensions of semiconductor have been found to give particularly good results, since the submicroscopic particles may then in part layer on silver halide crystal. However, it will be appreciated from the foregoing discussion of theoretical considerations that the sensitizing activity of the semiconductor is not dependent upon the formation of an actual semiconductor layer as such; rather, electron transfer can take place readily provided there is at least minimum effective electronic contact between respective reactants. Insofar as silver halide sensitization is concerned, there is no theoretical maximum particle size for the semiconductor. However, the particles should be of sufficiently small size, as well as concentration, so as not to interfere with the photographic characteristics of the silver halide emulsion, as by reflecting and/or scattering incident actinic radiation to any significant extent. It will be appreciated that absolute numbers as applied to a specific semiconductor particle size and ratio to a silver halide are only meaningful with respect to a single specified silver halide system and that one of ordinary skill in the art possessing the present invention would readily be able to determine empirically the specific parameters which must be utilized to give optimum sensitizing results in the practice of the invention.

It will be recognized that semiconductor particles for use within the scope of the present invention may be readily prepared by any of the conventional techniques, for example, ball mill, sand grinding, ultrasonic, and the like, for the production of particulate solid materials. In general, a wet paste comprising solid semiconductor particles, and optionally, one or more dispersing agents, surfactants, antifoamers, antioxidants, or the like, and water may be processed according to the identified techniques to provide particles of the size desired and the output of the process selected, where desired, may be appropriately filtered to effect removal of any particles which may be present exceeding that of a diameter within the particle size range desired.

Conventional sand grinding techniques adapted to mill solid particles such as to provide the requisite particle size distribution generally comprise agitating an aqueous semiconductor slurry with a sand, which, for example, may possess a size range of 20 to 40 mesh, until the desired particle size distribution is obtained and then separating the semiconductor from contact with the abrasive sand. Commercial mills, of various capacities, adapted to perform sand grinding, may be procured from the Chicago Boiler Company, Chicago, Ill., U.S.A.

For the preparation of semiconductor material possessing the desired particle size distribution by ultrasonic techniques, an aqueous semiconductor slurry may be treated employing commercial sonifiers such as those procured from Bronson Instruments, Incorporated, Stamford, Conn., U.S.A.

Subsequent to sensitization, any further desired additives, such as coating aids and the like, may be incorporated in the emulsion and the mixture coated and processed according to the conventional procedures known in the photographic emulsion manufacturing art.

The sensitized formulation may then be coated on an appropriate support as, for example, cellulose triacetate film base and the film units thus prepared exposed in a conventional wedge spectrograph to detail wavelength specific sensitivity of the formulation to incident electromagnetic radiation.

Upon processing with a photographic developing composition as, for example, a conventional processing composition of the type commerically distributed by Eastman Kodak Company, Rochester, N.Y., U.S.A., under the trade name of "KODAK D-19 Developer" and comprising an aqueous alkaline solution of p-methylamino phenol sulfate and hydroquinone, and a conventional acid stop bath, the resultant spectrograms will detail the sensitivity characteristics of the sensitized formulation of the present invention which may be directly compared with a control formulation which does not contain the described semiconductor.

As previously detailed, the photoresponsive crystals of the present invention may be employed as the photosensitive component of a photographic emulsion by incorporated within a suitable binder and the coating and processing of the thus prepared emulsion according to conventional procedures known in the photographic manufacturing art.

The photoresponsive crystal material of the photographic emulsion will, as previously described, preferably comprise a crystal of a silver compound, for example, one or more of the silver halides such as silver chloride, silver bromides, or mixed silver halides such as silver chlorobromide, silver iodobromide or silver iodochlorobromide or varying halide ratios and varying silver concentrations.

The extended range of spectral sensitivity is determined by the long wavelength absorption edge of the selected semiconductor.

A particularly preferred semiconductor contemplated for employment in the practice of the present invention comprises GaS.

The fabricated emulsion may be coated onto various types of rigid or flexible supports, for example, glass, paper, metal, polymeric films of both the synthetic types and those derived from naturally occurring products, etc. Especially suitable materials include paper; aluminum; polymethacrylic acid, methyl and ethyl esters; vinyl chloride polymers; polyvinyl acetals; polyamides such as nylon; polyesters such as the polymeric films derived from ethylene glycol terephthalic acid; polymeric cellulose derivatives such as cellulose acetate, triacetate, nitrate, propionate, butyrate, acetate-butyrate, or acetate-propionate; polycarbonates; polystyrenes, etc.

The emulsion may also contain one or more innocuous coating aids such as saponin; a polyethyleneglycol of U.S. Pat. No. 2,831,766; a polyethyleneglycol ether of U.S. Pat. No. 2,719,087; a taurine of U.S. Pat. No. 2,739,891; a maleopimarate of U.S. Pat. No. 2,823,123; an amino acid of U.S. Pat. No. 3,038,804; a sulfosuccinamate of U.S. Pat. No. 2,992,108; or a polyether of U.S. Pat. No. 2,600,831; or a gelatin plasticizer such as glycerin; a dihydroxyalkane of U.S. Pat. No. 2,960,404; a bisglycolic acid ester of U.S. Pat. No. 2,904,434; a succinate of U.S. Pat. No. 2,940,854; or a polymeric hydrosol of U.S. Pat. No. 2,852,386.

As the binder for photosensitive crystals, the aforementioned gelatin may be, in whole or in part, replaced with some other colloidal material such as albumin, casein; or zein; or resins such as cellulose derivatives and vinyl polymers such as described in an extensive multiplicity of readily available U.S. and foreign patents.

The photographic emulsions may be employed in black-and-white or color photographic systems, of both the additive and subtractive types, including diffusion transfer systems, for example, those described in *Photography, Its Materials and Processes*, supra, wherein direct positive emulsions are conventionall employed.

The photoresponsive crystals of the present invention may also be employed as the photosensitive component of information recording elements which employ the distribution of a dispersion of relatively discrete photoresponsive crystal, substantially free from interstitial binding agents, on a supporting member such as those previously designated, to provide image recording elements, for example, as described in U.S. Pat. Nos. 2,945,771; 3,142,566; 3,142,567; Newman, *Comment on Non-Gelatin Film*, B.J.O.P., 534, Sept. 15, 1961; and Belgian Pat. Nos. 642,557 and 642,558.

As taught in the art, the concentration of silver halide crystals forming a photographic emulsion and the relative structural parameters of the emulsion layer, for example, the relative thickness, and the like, may be varied extensively and drastically, depending upon the specific photographic system desired and the ultimate employment of the selective photographic system.

In conventional direct positive photographic processes, for the formation of silver images, a latent image carried by a fogged silver halide system is formed by selective exposure of a photosensitive photographic system, generally containing the aforementioned photoresponsive silver halide crystals or the like. The residual latent image is developed, to provide a visible silver image, by a suitable contact with any of the photographic developing solutions set forth in the art. For the purpose of enhancing the resultant visible image's stability, the image may be suitably fixed, according to the procedures also well known to those skilled in the art. The resultant image-containing element may be then directed employed or, optionally, may be employed, where applicable, as a positive image, for example, to provide a reversed or negative image by conventional contact or projection printing processes employing suitable photosensitive printing papers.

The present invention will be illustrated in greater detail in conjunction with the following specific example which sets forth a representative fabrication of the film units of the present invention, which, however, is not limited to the detailed description herein set forth but is intended to be illustrative only.

EXAMPLE

A direct positive silver chloride emulsion was prepared according to the teachings of U.S. Pat. No. 3,537,858. One portion was retained as a control.

To 10 g. of the emulsion was added 14 g. of a 10:1 gelatin solution and 2.4 ml. of water. The mixture was melted for 15 minutes and then 4 g. of methanol were added. After mixing for 10 minutes a sonified mixture of 0.9465 g. of gallium sulfide (to give a 1:1 Ag:Gas mole ratio) and 10 ml. of water were added, mixed for 30 seconds after which 1 ml. of a 1% solution of the sodium salt of dioctyl sulfosuccinate was added. The emulsions were coated with a No. 30 Meyer rod and air dried. Exposure was carried out with a wedge spectrograph and development with KODAK D-19 developer.

Kodak Developer D-19 is commercially available from Eastman Kodak Company, Rochester, N.Y., and has the following composition:

| | |
|---|---|
| Water (125° C) | 500.0 ml |
| Kodak Elon | 2.0 gms. |
| Kodak Sodium Sulfite, dessiccated | 90.0 gms. |
| Kodak Hydroquinone | 8.0 gms. |
| Kodak Sodium Carbonate, monohydrated | 52.5 gms. |
| Kodak Potassium Bromide | 5.0 gms. |
| Add cold water to make | 1.0 liter |

Figure 2:
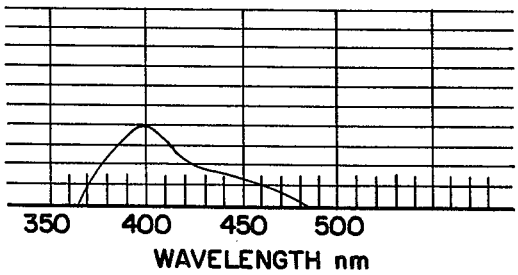
FIG. 2 is a graphical representation of the action spectra of a direct positive silver chloride emulsion formulation to which has been added a particulate dispersion of a semiconductor in accordance with the present invention.

A comparison of the figures shows an extended range of spectral sensitization with the emulsion of the present invention (FIG. 2) as compared with a control (FIG. 1) which is the same emulsion without the gallium sulfide additive.

Since certain changes may be made in the above product without departing from the scope of the invention herein involved, it is intended that all matter contained in the above description or shown in the accompanying drawings shall be interpreted as illustrative and not in a limiting sense.

What is claimed is:

1. A direct positive photosensitive element which comprises a particulate dispersion of fogged silver halide crystals, adapted to discharge the fog upon exposure of said crystals to incident electromagnetic radiation actinic thereto, having in contact therewith in electron accepting relationship a particulate dispersion of gallium sulfide semiconductor adapted to accept electrons from said silver halide crystals as a function of said exposure of said crystals to said incident electromagnetic radiation actinic thereto.

2. A direct positive photosensitive element as defined in claim 1 wherein said silver halide crystals possess a conduction band energy level above that possessed by said semiconductor.

3. A direct positive photosensitive element as defined in claim 2 wherein said silver halide crystals are silver chloride crystals.

4. A direct positive photosensitive element as defined in claim 1 wherein said silver halide crystals and said semiconductor are disposed in a polymeric matrix.

5. A direct positive photosensitive element as defined in claim 4 wherein said polymeric matrix comprises gelatin.

6. A method of spectrally sensitizing a direct positive silver halide emulsion comprising a particulate dispersion of fogged silver halide crystals adapted to discharge the fog upon exposure of said crystals to electromagnetic radiation actinic thereto, by adding thereto a particulate dispersion of a gallium sulfide semiconductor in a liquid medium wherein said semiconductor is insoluble; said semiconductor adapted to accept electrons from said silver halide crystals as a function of said exposure of said crystals to said incident electromagnetic radiation actinic thereto.

* * * * *